US007758267B1

(12) United States Patent
Zhang

(10) Patent No.: US 7,758,267 B1
(45) Date of Patent: Jul. 20, 2010

(54) COSMETIC CONTAINER WITH LIGHT

(75) Inventor: Jun Zhang, Jhonghe (TW)

(73) Assignee: Allen & Thomas Cosmetic Accessories Co., Ltd, Zhuhai, Guang Dong Province (CN)

( * ) Notice: Subject to any disclaimer, the term of this patent is extended or adjusted under 35 U.S.C. 154(b) by 97 days.

(21) Appl. No.: 12/193,804

(22) Filed: Aug. 19, 2008

(51) Int. Cl.
*B43K 23/00* (2006.01)

(52) U.S. Cl. ..... 401/52; 401/98; 401/76

(58) Field of Classification Search ..... 401/52, 401/195, 75, 76, 68, 171, 172, 173, 98, 116, 401/202, 269; 362/136, 137
See application file for complete search history.

(56) References Cited

U.S. PATENT DOCUMENTS 4,888,667 A * 12/1989 Hwang ..... 362/109
6,789,972 B2 * 9/2004 Nadel ..... 401/195
6,991,345 B2 * 1/2006 Helenowski ..... 362/137
7,448,767 B2 * 11/2008 Zhang ..... 362/118

* cited by examiner

*Primary Examiner*—David J Walczak
(74) *Attorney, Agent, or Firm*—Ming Chow; Sinorica, LLC

(57) ABSTRACT

A cosmetic container includes a cap comprising a hinged top cover and a rear opening; a frame comprising a top hole, a slit besides the hole, and a hollow cylinder; a light assembly comprising a lamp disposed in the hole, a battery, and a spring biased switch; and a shell and pomade assembly comprising a shell, a carrier fixedly secured to the shell, a sleeve rotatably secured to the carrier, a pomade secured to the carrier and disposed in the sleeve, and a hollow neck releasably secured to the shell and the cylinder. Prior to projecting the pomade opening the cover will expand the spring to close the switch and electrically connect the switch, the lamp, and the battery together to cause the lamp to emit light.

9 Claims, 7 Drawing Sheets

COSMETIC CONTAINER WITH LIGHT

BACKGROUND OF THE INVENTION

1. Field of Invention

The invention relates to cosmetic containers and more particularly to such a cosmetic container (e.g., lipstick) having a battery powered light.

2. Description of Related Art

Conventionally, for example, a woman may use a mirror as an auxiliary tool to apply pomade of a lipstick to the lips in a bright environment. Hence, a type of lipstick with a light and a mirror is commercially available. The conventional lipstick is shown in FIG. 7. The lipstick comprises a shell 41 having two bottom holes 411; a light assembly mounted in the shell 41 and comprising two upper lamps 423, a plurality of intermediate cells 422, and two contacts 421 provided in the hole 411 in which one contact 421 is electrically connected to the lamps 423 and the other contact 421 is electrically connected to the cells 422; a pomade 44 mounted on the top central portion of the shell 41 above the cells 422 and disposed between the lamp 423; and a cap 43 releasably secured to the top edge of the shell 41 with the above components concealed therein in a non-use position, the cap 43 comprising a mirror 431 on its outer surface.

In use, an individual may first remove the cap 43. Next, one hand holds the mirror 431 and orient same toward the mouth and the other hand holds the shell 41 with the lamps 423 facing the mouth. Next, the fingers of the other hand press an insulative membrane (not shown) to cause the contacts 421 to electrically interconnect. Hence, electric energy is supplied from the cells 422 to the lamps 423 via the contacts 421. As a result, the mouth, particularly the lips, is lit by light rays emitted by the lamps 423. Therefore, the individual may begin to apply lipstick to the lips.

However, the well known lipstick suffers from several disadvantages. For example, both hands are full and the fingers of the other hand are required to press the membrane continuously throughout the makeup. This may cause discomfort to the other hand if the makeup takes a relative long period of time. Further, it is not convenient. Moreover, the emitted light may be partially blocked by the pomade 44 which typically has a diameter of about 1 cm. And in turn, not sufficient light is directed toward the mirror 431, i.e., the image shown in the mirror 431 may be blurry. As an end, the makeup may be done in a difficult way. Thus, a need for improvement exists.

SUMMARY OF THE INVENTION

It is therefore one object of the invention to provide a cosmetic container having a battery powered light which is adapted to emit sufficient light when the container is open.

The above and other objects, features and advantages of the invention will become apparent from the following detailed description taken with the accompanying drawings.

DETAILED DESCRIPTION OF THE INVENTION

Figure 1:
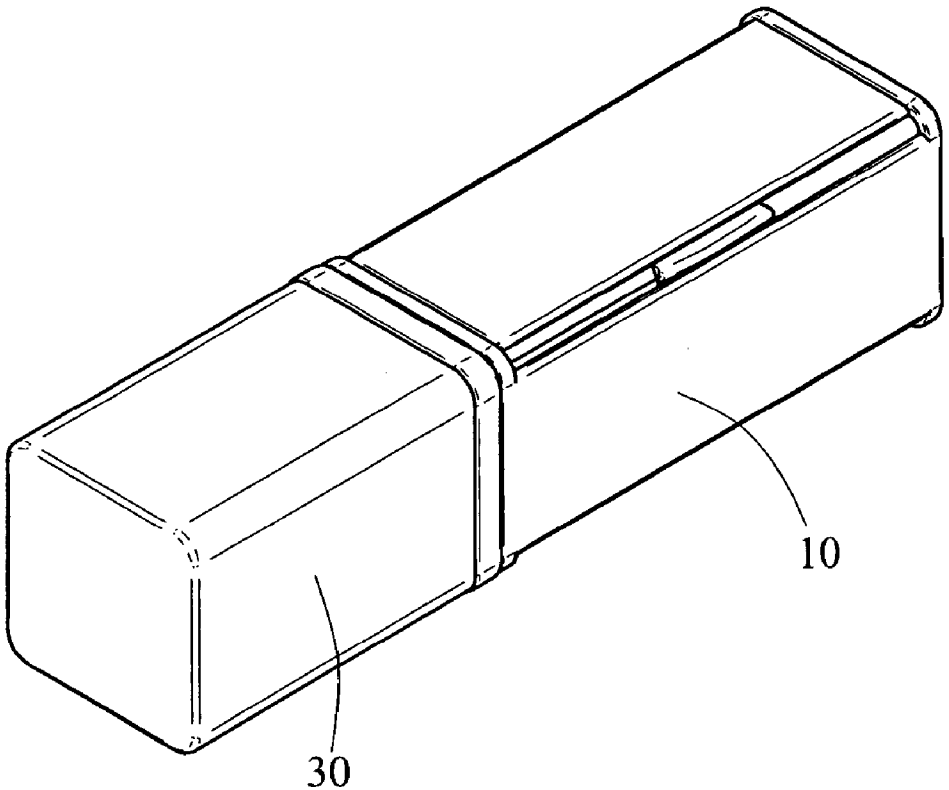
FIG. 1 is a perspective view of a lipstick according to the invention.

Referring to FIGS. 1 to 6, a lipstick in accordance with the invention comprises a cap 10, a light and frame assembly 20, and a shell and pomade assembly 30. Each component will be discussed in detail below.

The cap 10 is a hollow rectangular member and comprises an internal space 11 for mounting the light and frame assembly 20, a hinged cover 12 on the top, and an opening 13 with a stepped shoulder at a rear end facing the shell and pomade assembly 30.

The light and frame assembly 20 comprises a three-dimensional frame 22 including a top truncated cone-shaped hole 221, a top slit 222 besides the hole 221, and a lengthwise hollow cylinder 223 with internal threads (not shown); and a light assembly 21 comprising a lamp (e.g., an LED (light-emitting diode) lamp) 212 disposed slightly below the hole 221 in a non-operating state and having a first lead 2121 and a second lead 2122, two cells 213 series connected together, and a switch 211 including a push button 2111 disposed in the slit 222 in the non-operating state, an actuation member 2116 integrally formed with the push button 2111, a spring (e.g., helical spring) 2112 having a top end anchored on the bottom of the actuation member 2116 and a bottom end urged against the bottom of the cap 10, a conductive member 2115 having one end electrically connected to the first lead 2121 and the other end projecting through a slot (not numbered) of the actuation member 2116, a first contact 2113 electrically connected to a positive terminal of one cell 213 and spaced from the second lead 2122 by a predetermined distance, and a second contact 2114 electrically connected to a negative terminal of the other cell 213 and spaced from the conductive member 2115 by a predetermined distance.

The shell and pomade assembly 30 comprises a shell 31 of rectangular section, a carrier 32 including a tube 321 fixedly secured to the bottom of the shell 31, the tube 321 having internal threads 3211, and a stem 322 having two opposite rear lugs 3221 provided in a predetermined position of the threads 3211 in the non-operating state, a sleeve 34 with the front portion of the stem 322 retained therein and secured thereto, a pomade 35 secured to the front end of the stem 322 and provided in the sleeve 34, and a hollow neck 33 of rectangular section including a front peripheral flange 332 and a forward tubular extension 331 extending from the flange 332 the extension 331 having outer threads (not numbered), the extension 331 being adapted to pass the opening 13 into the cylinder 223 to secure to the internal threads of the cylinder 223 so that the cap 10, the light and frame assembly 20, and the shell and pomade assembly 30 are secured together in the non-operating state. The neck 33 is inserted into the shell 31 with the flange 332 closely complementing a peripheral shoulder (not numbered) on the front end of the shell 31 such that the shell and pomade assembly 30 may have a smooth surface. The sleeve 34 has its rear annular flange (not numbered) secured to the rear end of the neck 33 and the remaining portion thereof passing through the neck 33 into the cylinder 223.

While the pomade 35 is described as lipstick as a preferred embodiment of the invention, it is understood that the pomade 35 may be as lip polish, eyebrow pencil, or the like without departing from the scope of the invention.

An operation of the invention will be described in detail below. In a non-operating state, the cover 12 is closed with the push button 2111 being pushed down and the spring 2112 being compressed (see FIG. 1). Also, the first contact 2113 is not electrically connected to the second lead 2122 and the second contact 2114 is not electrically connected to the conductive member 2115. That is, the circuit is open and the lamp 212 is turned off.

Figure 2:
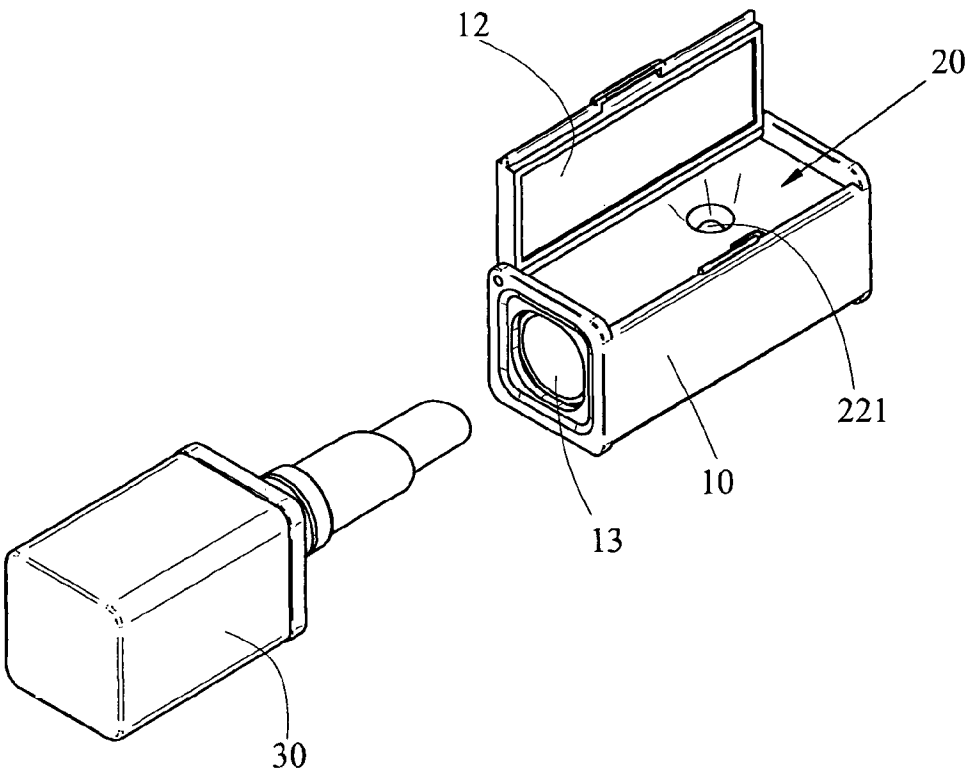
FIG. 2 is a perspective view of the lipstick in a ready to use state.
Figure 3:
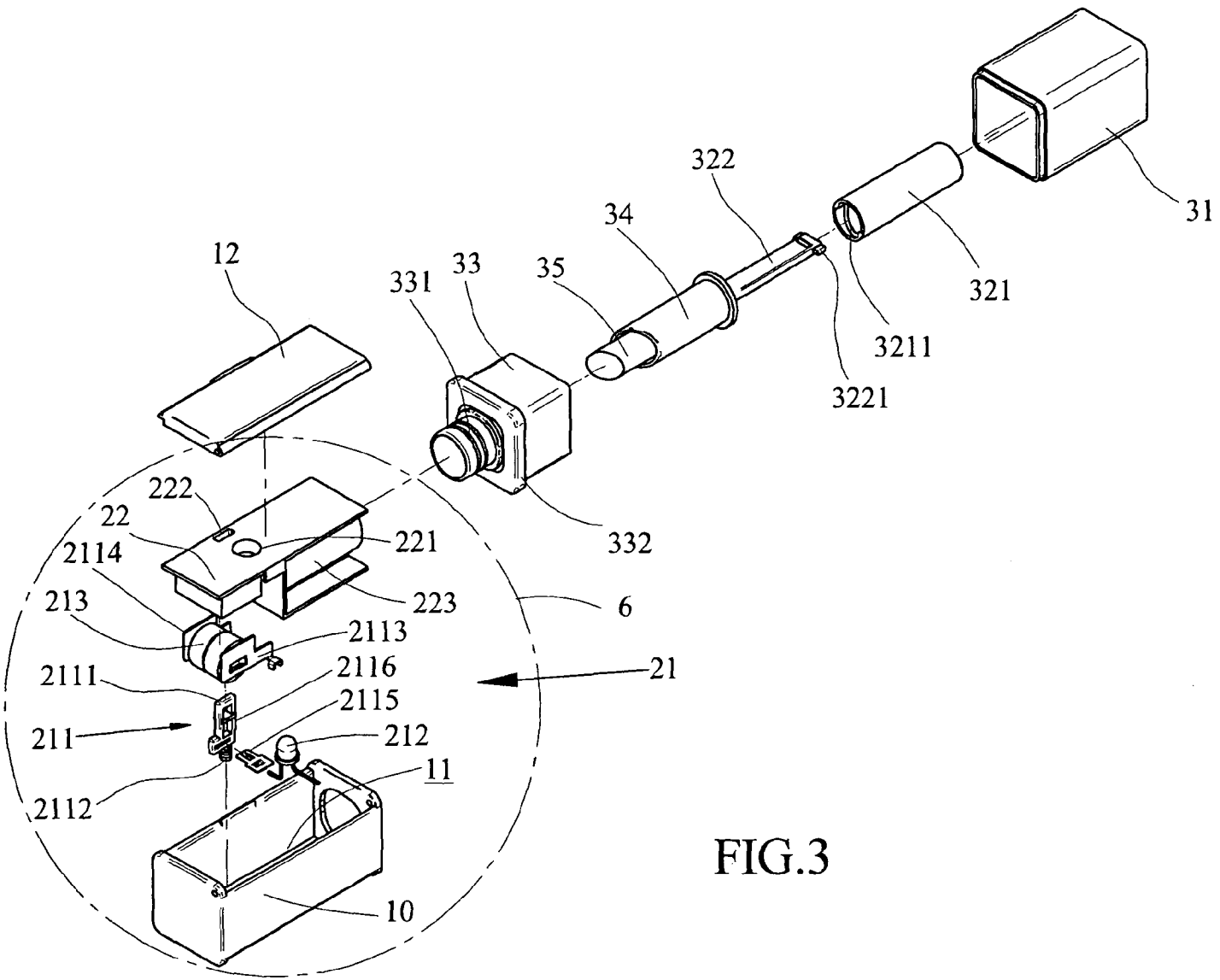
FIG. 3 is an exploded view of the lipstick.
Figure 4:
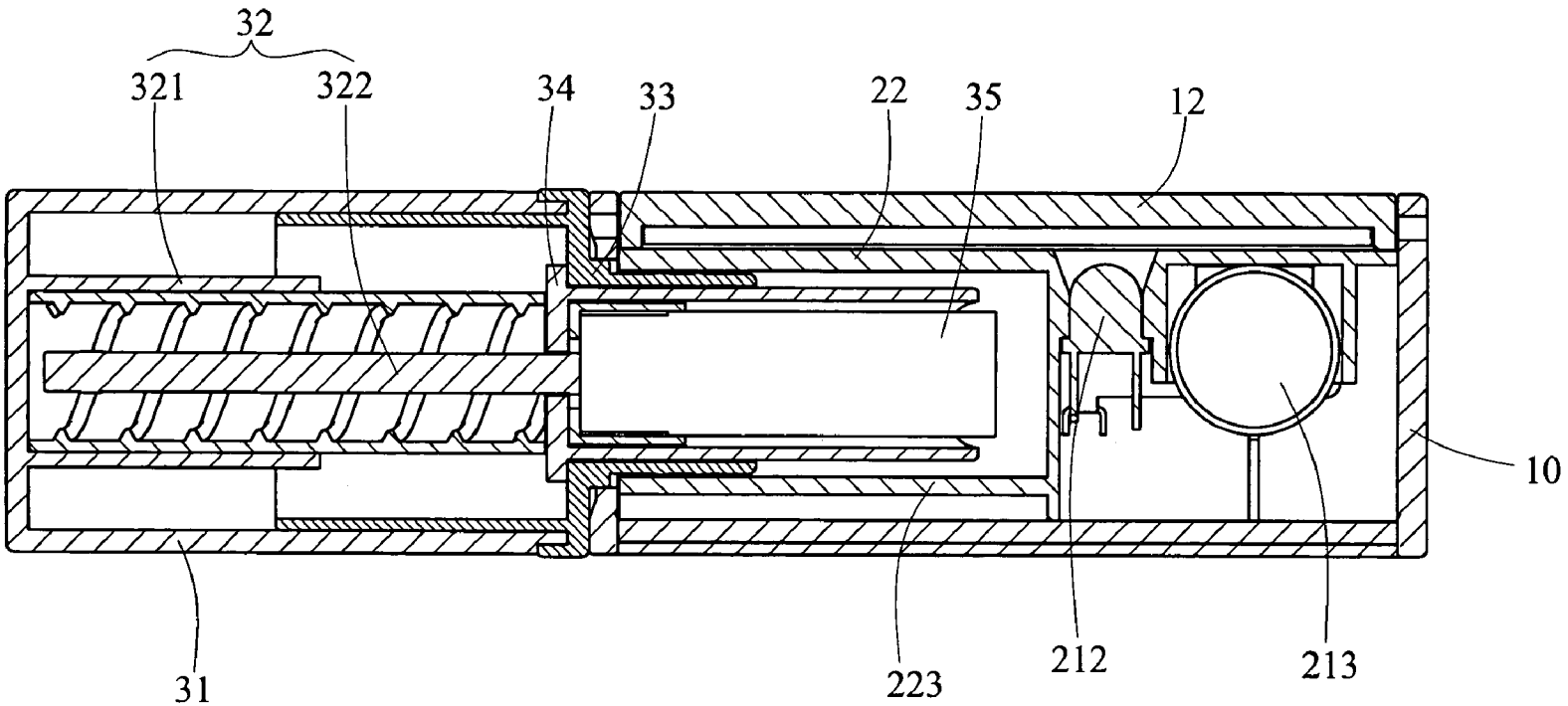
FIG. 4 is a longitudinal sectional view of the lipstick of FIG. 1.
Figure 5:
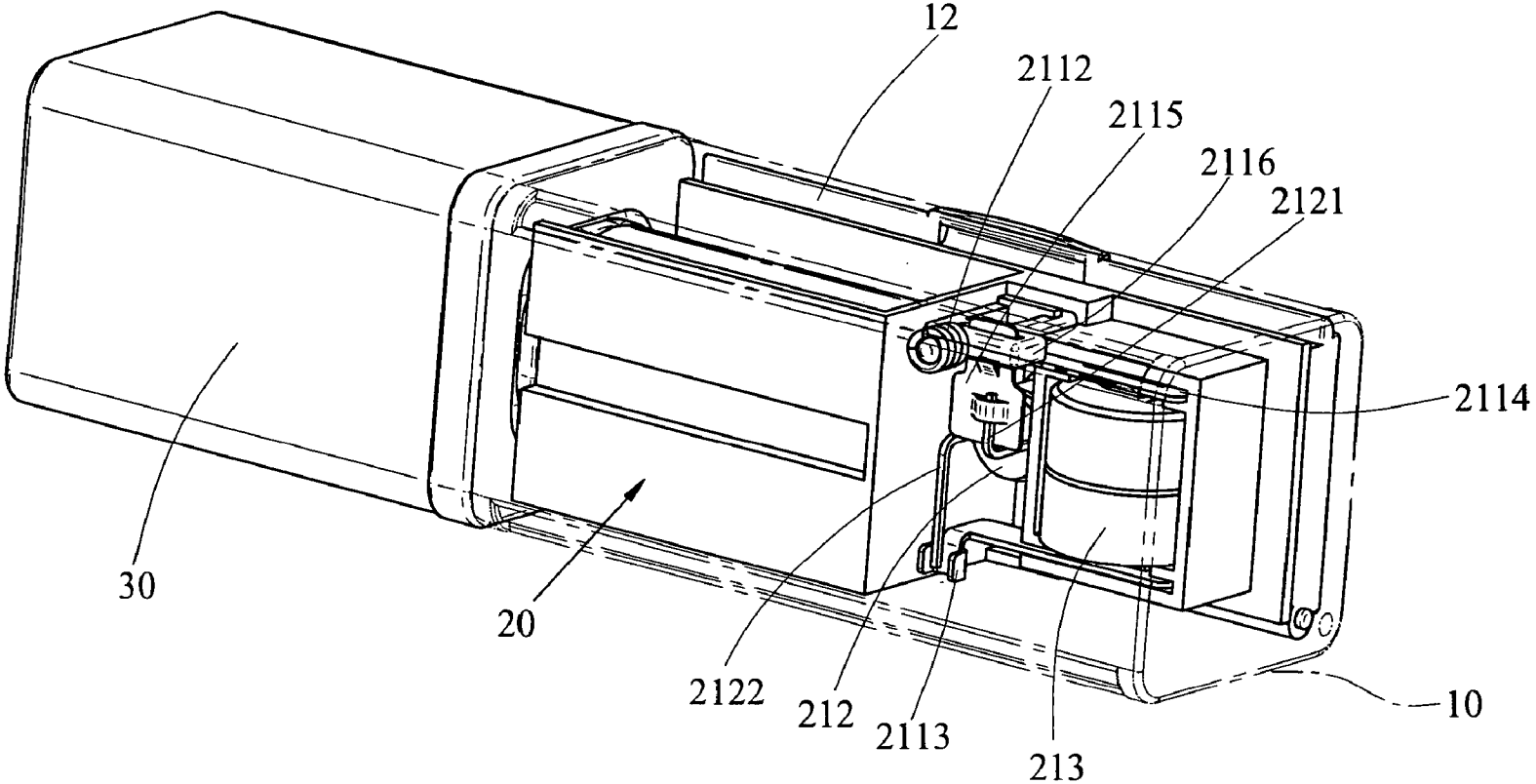
FIG. 5 is a perspective view of the lipstick with the cap being shown as transparent for showing the light and frame assembly.
Figure 6:
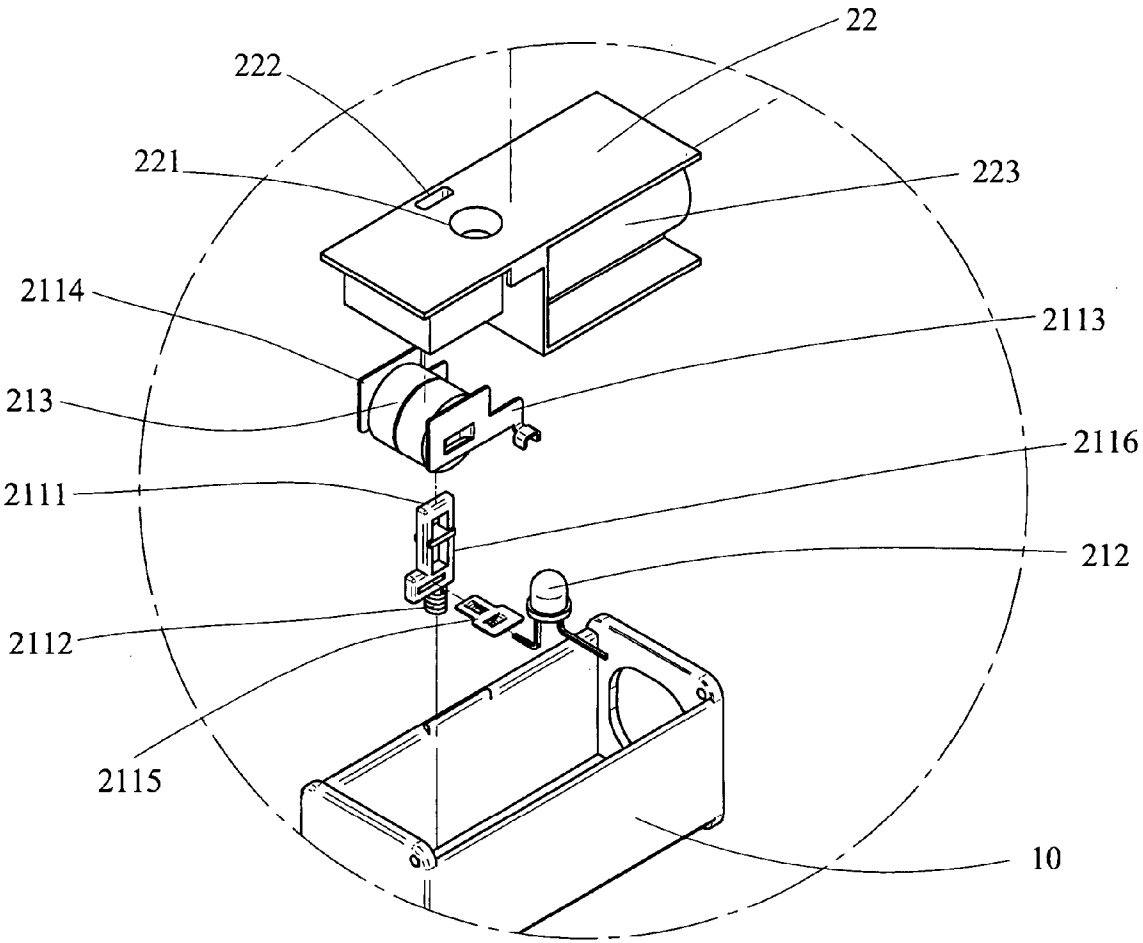
FIG. 6 is a detailed view of the area in circle 6 of FIG. 3.
Figure 7:
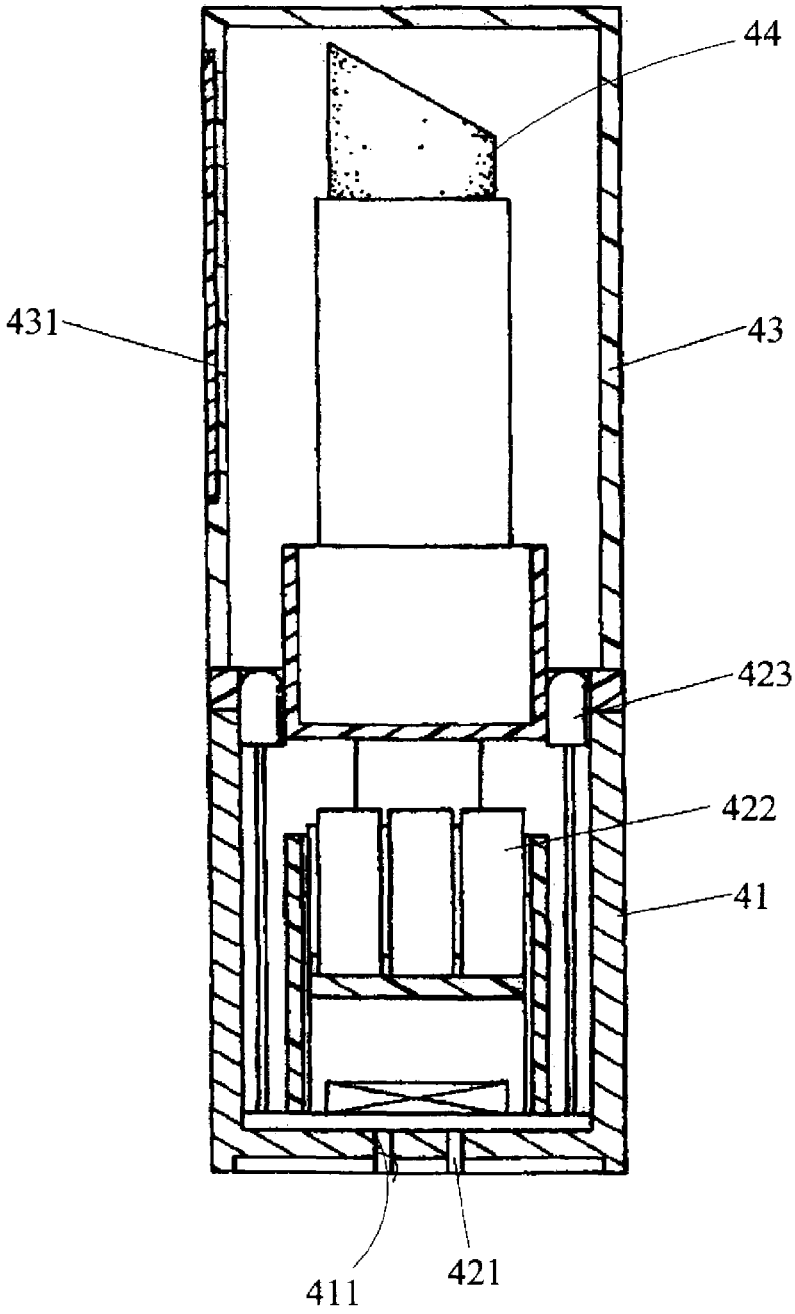
FIG.7 PRIOR ART
FIG. 7 is a longitudinal sectional view of a conventional lipstick with a light.

For use, an individual may open the cover 12 by pulling a tab (not numbered) on one edge thereof (see FIG. 2). Immediately, the energized spring 2112 expands upward to push the push button 2111 slightly out of the slit 222. And in turn, the actuation member 2116, the conductive member 2115, and the lamp 212 move upward in which the lamp 212 further disposes in the hole 221. Hence, the conductive member 2115 contacts the second contact 2114 and the second lead 2122 contacts the first contact 2113. As a result, the circuit is closed and the lamp 212 emits light.

Thereafter, the individual may detach the shell and pomade assembly 30 from the cap 10. Next, the individual may rotate the sleeve 34, for example, clockwise to rotate the lugs 3221 same along the threads 3211. As a result, the pomade 35 slowly projects out of the sleeve 34. Therefore, the individual may apply the pomade 35 to the lips for makeup.

While the invention herein disclosed has been described by means of specific embodiments, numerous modifications and variations could be made thereto by those skilled in the art without departing from the scope and spirit of the invention set forth in the claims.

What is claimed is:

1. A cosmetic container comprising:

a cap comprising a hinged top cover and a rear opening;

a frame comprising a top hole, a slit besides the hole, and a hollow cylinder;

a light assembly comprising a lamp disposed in the hole, at least one cell, and a switch including a biasing member biasing against a bottom thereof and an inner surface of the cap; and a shell and pomade assembly comprising a shell, a carrier fixedly secured to the bottom of the shell, a sleeve rotatably secured to the carrier, a pomade secured to the carrier and disposed in the sleeve, and a hollow neck having a rear end inserted into the shell and a front end releasably secured to the cylinder after passing the opening;

wherein in a non-operating state the switch is pushed down by the cover, the biasing member is compressed, and the light assembly is disabled;

the cover is adapted to open to expand the biasing member to close the switch and electrically connect the switch, the lamp, and the at least one cell together to cause the lamp to emit light; and the shell and pomade assembly is adapted to detach from the cap so that a rotation of the sleeve in a predetermined direction will cause the carrier to push the pomade out of the sleeve and the neck.

2. The cosmetic container of claim 1, wherein the lamp is an LED lamp and has first and second leads extending therefrom.

3. The cosmetic container of claim 2, wherein the switch further comprises a push button disposed in the slit, a conductive member having one end electrically connected to the first lead and the other end passing the push button, a first contact electrically connected to a positive terminal of the at least one cell and spaced from the second lead by a predetermined distance, and a second contact electrically connected to a negative terminal of the at least one cell and spaced from the conductive member by a predetermined distance such that the push button, the conductive member, and the lamp move upward in response to the cover opening and the conductive member contacts the second contact and the second lead contacts the first contact to turn on the lamp.

4. The cosmetic container of claim 3, wherein the push button is adapted to project out of the slit a predetermined distance in response to the cover opening.

5. The cosmetic container of claim 1, wherein the carrier comprises a tube fixedly secured to the bottom of the shell, the tube having internal threads, and a stem having two opposite rear lugs disposed in the threads of the tube, the sleeve and a front portion of the stem are secured together, the pomade is secured to a front end of the stem and disposed in the sleeve, the neck comprises a tubular front extension adapted to pass the opening to fasten in the cylinder, the neck is to inserted into the shell, and the sleeve is adapted to rotate in the predetermined direction to rotate the lugs along the threads of the tube to cause the stem to push the pomade out of the sleeve and the neck.

6. The cosmetic container of claim 5, wherein the cylinder has internal threads, and the extension has external threads adapted to secure to the internal threads of the cylinder.

7. The cosmetic container of claim 1, wherein the biasing member is a helical spring.

8. The cosmetic container of claim 1, wherein the pomade is a lipstick, a lip polish, or an eyebrow pencil.

9. The cosmetic container of claim 1, wherein the hole is truncated conic.

* * * * *

UNITED STATES PATENT AND TRADEMARK OFFICE

CERTIFICATE OF CORRECTION

PATENT NO. : 7,758,267 B1
APPLICATION NO. : 12/193804
DATED : July 20, 2010
INVENTOR(S) : Jun Zhang It is certified that error appears in the above-identified patent and that said Letters Patent is hereby corrected as shown below:

Title page item (73), Assignee should read
-- Assignee: ALLEN & THOMAS COSMETIC ACCESSORIES CO., LTD, Zhuhai, Guang Dong Province (CN) UNIQUE DESIGN PACKAGING CO., LTD., Zhuhai, Guang Dong Province (CN) --

Signed and Sealed this

Sixteenth Day of November, 2010

David J. Kappos

David J. Kappos
*Director of the United States Patent and Trademark Office*